US006073404A

United States Patent [19]

Norfleet

[11] Patent Number: 6,073,404

[45] Date of Patent: Jun. 13, 2000

[54] MODEL BUILDING

[76] Inventor: George Norfleet, 3601 U St., SE., Washington, D.C. 20020-2431

[21] Appl. No.: 08/989,459

[22] Filed: Dec. 12, 1997

[51] Int. Cl.[7] ..... A63H 33/12; A63H 33/08; A63H 33/04; E04B 1/38

[52] U.S. Cl. ..... 52/236.3; 52/79.1; 52/79.12; 52/64; 52/270; 52/285.1; 52/584.1; 446/109; 446/110; 446/112; 446/113; 446/115; 446/116; 446/123; 446/124

[58] Field of Search ..... 446/105, 108–116, 446/123, 124; 52/79.1, 79.12, 236.3, 270, 582.2, 747.1, 284, 285.1, 584.1, 64

[56] References Cited

U.S. PATENT DOCUMENTS

| | | | |
|---|---|---|---|
| 1,608,273 | 11/1926 | Glasgow . | |
| 1,886,363 | 11/1932 | Aufderheide . | |
| 1,913,066 | 6/1933 | Carter | 52/270 |
| 2,204,319 | 6/1940 | Parsons et al. . | |
| 2,647,287 | 8/1953 | Jones . | |
| 2,904,927 | 9/1959 | Katz . | |
| 2,931,130 | 4/1960 | Rietz . | |
| 3,002,315 | 10/1961 | Kuhn . | |
| 3,305,982 | 2/1967 | Steele | 52/236.3 X |
| 3,372,519 | 3/1968 | Russell | 52/285.1 X |
| 3,387,733 | 6/1968 | Field | 52/270 X |
| 3,392,497 | 7/1968 | Cushman | 52/582.2 X |
| 3,452,498 | 7/1969 | Kinsey | 52/284 X |
| 3,902,291 | 9/1975 | Zucht | 52/284 |
| 3,958,386 | 5/1976 | Pollock . | |
| 4,270,302 | 6/1981 | Dandia . | |
| 4,270,303 | 6/1981 | Xanthopoulos et al. . | |
| 5,002,513 | 3/1991 | Weiss . | |
| 5,134,826 | 8/1992 | La Roche et al. | 52/584.1 |
| 5,195,282 | 3/1993 | Campbell | 52/79.1 |
| 5,222,902 | 6/1993 | Piersch . | |
| 5,487,241 | 1/1996 | Gorrell et al. | 52/79.1 |
| 5,779,517 | 7/1998 | Clarke . | |

*Primary Examiner*—Robert Canfield
*Attorney, Agent, or Firm*—Cahn & Samuels, LLP

[57] ABSTRACT

A modular building model is provided. The modular building model includes a base and a lower level module disposed on and engaged with the base. An upper level module is disposed on and engaged with the lower level module. The base includes a releasable securing mechanism that secured the upper level module to the lower level module. The releasable securing mechanism permits easy assembly and disassembly of the model for travelling and storage purposes, and variation of mold buildings.

11 Claims, 5 Drawing Sheets

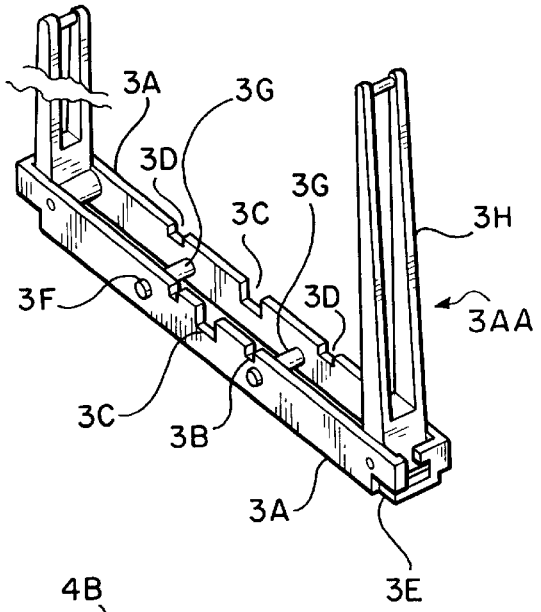
FIG. 3
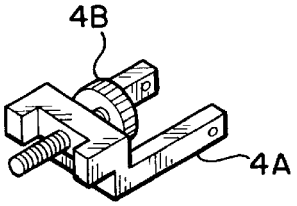
FIG. 4-1
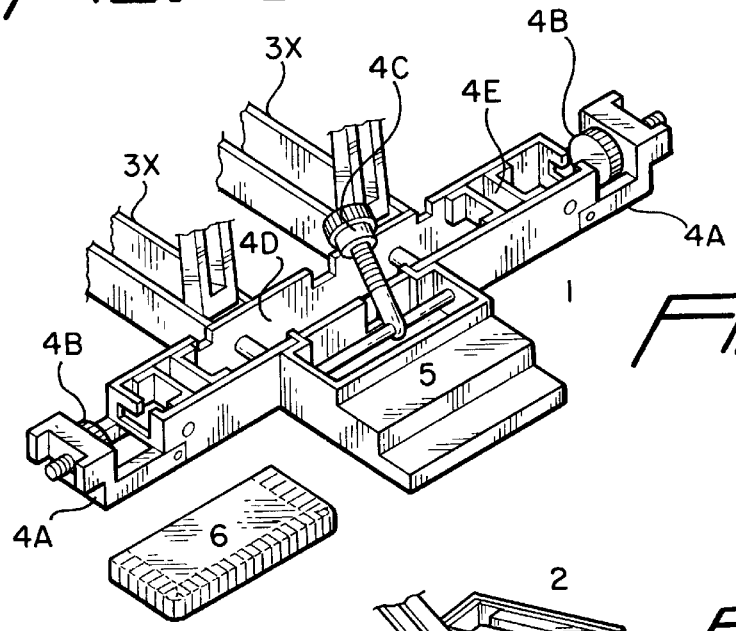
FIG. 4
FIG. 4-2
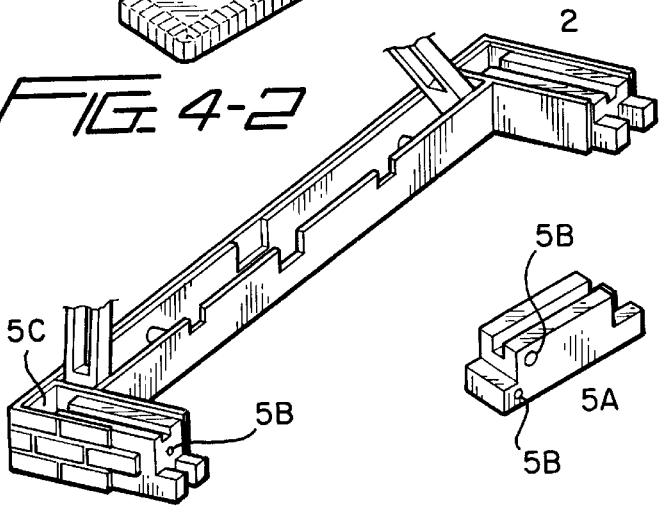
FIG. 5
FIG. 5-1

FIG. 6-1
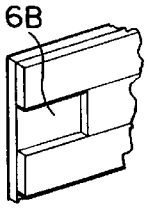
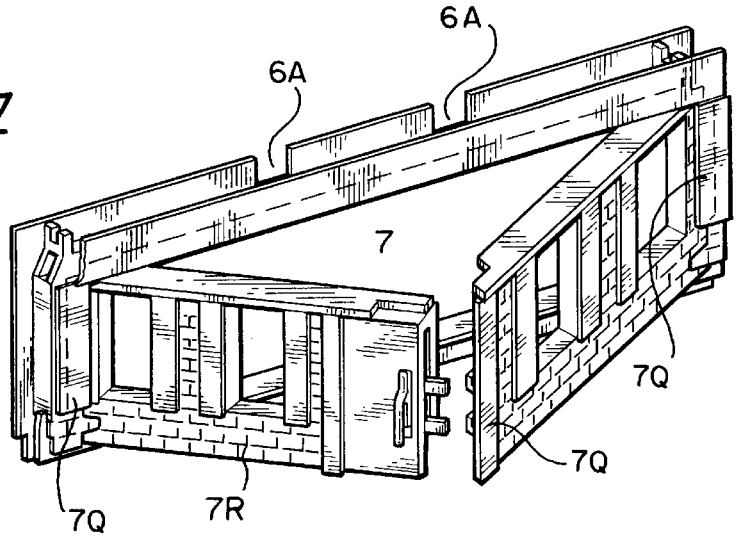
FIG. 6
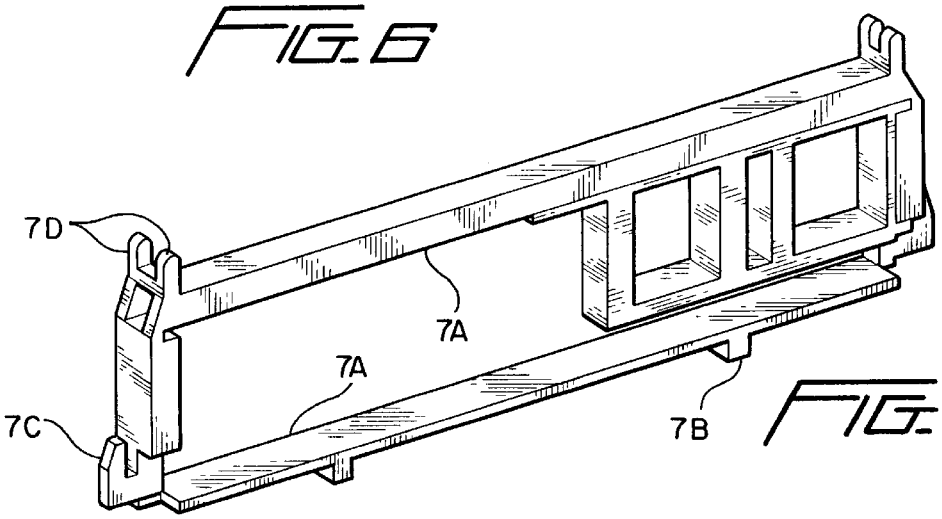
FIG. 7
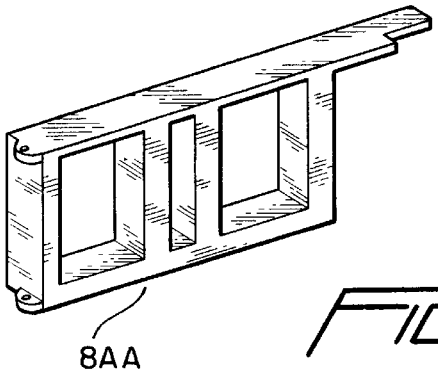
FIG. 8

FIG. 13
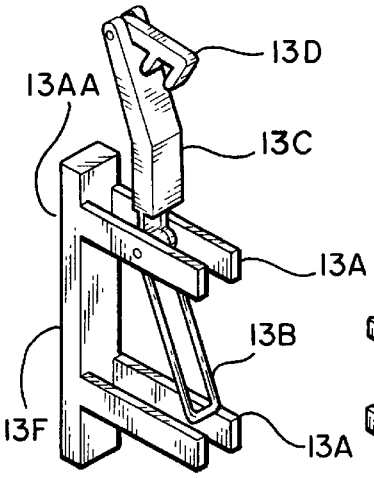
FIG. 12
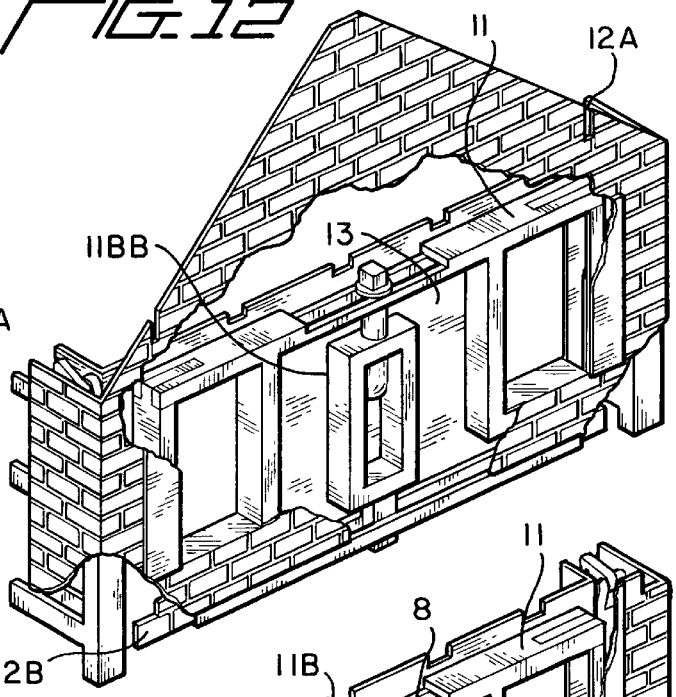
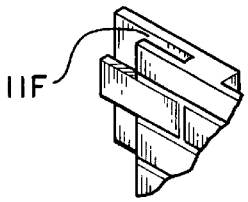
FIG. 11-1
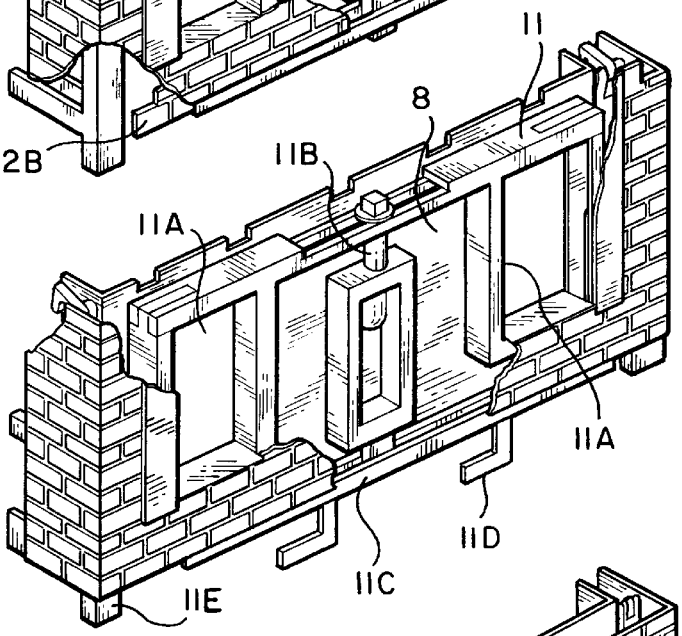
FIG. 11
FIG. 9
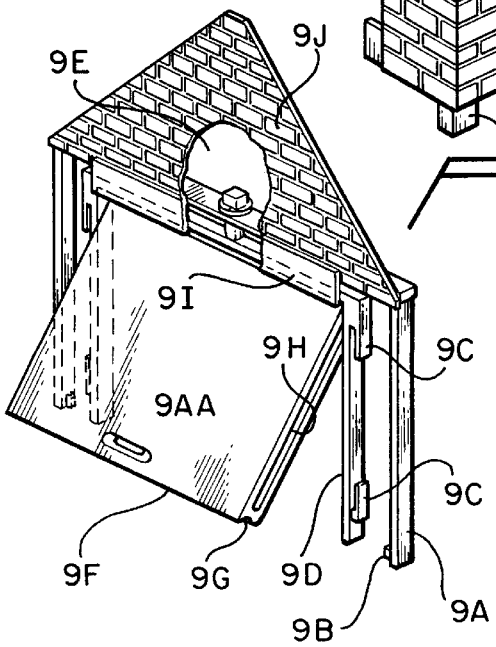
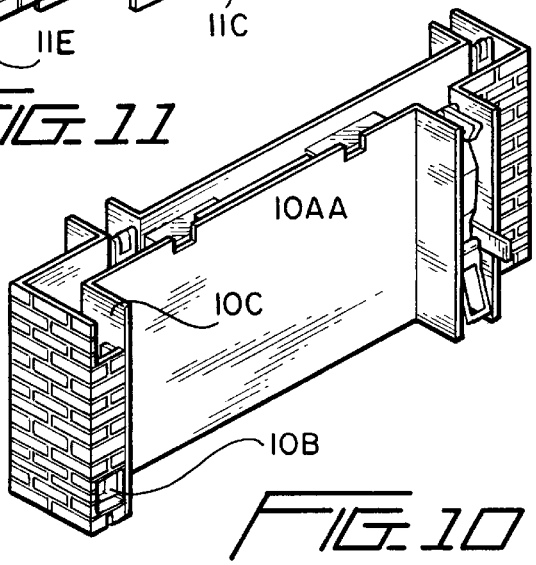
FIG. 10

MODEL BUILDING

TECHNICAL FIELD

The invention relates to model buildings and model building kits. More particularly, the invention relates to model building kits that permit ready assembly and disassembly of a variety of structures.

BACKGROUND OF THE INVENTION

Model buildings have been popular since the early 1900's and before, in particular in the form of toy houses. Many of the early model buildings were "collapsible". Other models were distinguished by their ability to fold away or be held together with frames, pegs, or dovetail joints. Typically, these models used connecting strips, and, in some cases, binding devices to secure structural elements. One of the problems with many of the early models is that they did not closely resemble real houses or allow ready access to interior compartments.

In recent years, kits have become widely available. Contemporary kits are predominantly pre-assembled wood shells that the user must complete and detail. They generally can be made larger only with add-ons—rooms, compartments, etc. The degree of variability of the interior and the overall design and layout is limited. These contemporary kits generally allow the user to construct models of only a single interior and exterior design.

Accordingly, there is a need for a model building kit that employs concealed, interchangeable and interlocking frames, and securing assemblies to hold pieces together. Further there is a need for a kit that includes individual base, floor, wall, ceiling, roof and molding pieces to allow model buildings of multiple design to be produced from a single kit.

SUMMARY OF THE INVENTION

The present invention relates to a model building kit and a modular model building. The building may be constructed from discrete, self-contained modules. A lower level module may include debase, a floor, a ceiling and a number of exterior and/or interior walls. The base, the walls, the ceiling and the floor are securely interconnected. Likewise, an upper level module may include a floor a ceiling and a number of exterior and/or interior walls. The walls, the ceiling and the floor are securely interconnected. Using this modular approach, buildings of various sizes shapes and layouts may be constructed.

In accordance with an aspect, the present invention is directed to a modular building structure. The structure includes a base and a lower level module engaged with and disposed on the base. An upper level module is disposed on and engaged with the lower level module. The base includes a releasable securing mechanism that secures the upper level module to the lower level module, and both and upper lower level modules to the base.

In accordance with another aspect, the present invention is directed to a module for a modular building structure. The module includes a base, first and second wall elements and a wall connector. The base includes a plurality of frame units and one of the frame units has a module attachment member the first wall element has a first securing mechanism for releasably securing the first wall element to the base. The second wall element has a second securing mechanism of releasably securing the second wall element to the base. The wall connector interconnects the first and second wall elements.

In accordance with still another aspect, the invention is directed to a combination of at least one lower level module and an upper level module. The lower level module includes a base that comprises a plurality of frame units. One of the frame units includes a module attachment member. The lower level module also includes a first wall element. The first wall element includes a wall frame that has a first securing mechanism for releasably securing the first wall element to the base. The lower level module also includes a second wall element. The second wall element is provided with a second securing mechanism for releasably securing the second wall element to the base. A wall connector is provided to interconnect the first and second wall elements.

The upper level module includes a first wall element. The first wall element includes a wall frame that has a first securing mechanism for releasably securing the first wall element to the lower level module. The upper level module also includes a second wall element. The second wall element is provided with a second securing mechanism for releasably securing the second wall element to the lower level module. A wall connector is provided to interconnect the first and second wall elements.

According to a further aspect, the present invention is directed to a method of assembling a modular building structure by constructing first and second modules, stacking the second module on the first module and releasably coupling the first and second modules. The first module may be constructed by coupling a panel to a base, releasably coupling first and second wall elements to the base and interconnecting the first and second wall elements. The second module may be constructed by interconnecting first and second upper wall elements and coupling a panel to the first and second upper wall elements.

BRIEF DESCRIPTION OF THE DRAWINGS

FIG. 3 illustrates a base frame unit including connecting arms and inter-lock posts.

FIG. 4 is a perspective view of the base front and rear piece.

FIG. 4-1 is a perspective view of an extension that may be connected to the end of the base frame unit of FIG. 3 to make base front and rear piece 1 shown in FIG. 4.

FIG. 4-2 depicts a landing.

FIG. 5 shows a perspective view of a base end corner piece.

FIG. 5-1 illustrates a corner block.

FIG. 6 is a perspective view of a partially opened front/rear side piece.

FIG. 6-1 is a cut away view of a strip of decorative facing taken from the front/rear side piece of FIG. 6.

FIG. 7 shows a front/rear side piece frame.

FIG. 8 shows a pivoting frame member of the front/rear side piece frame of FIG. 7.

FIG. 9 illustrates the garage front and door piece.

FIG. 10 shows the garage side wall piece.

FIG. 11 is a perspective view of a lower level end-wall piece

FIG. 11-1 is a cut away view of a plastic strip taken from the end wall piece of FIG. 11.

FIG. 12 is a perspective view of an upper level end wall piece.

FIG. 13 shows an end wall connector.

DETAILED DESCRIPTION OF THE INVENTION

Figure 2:
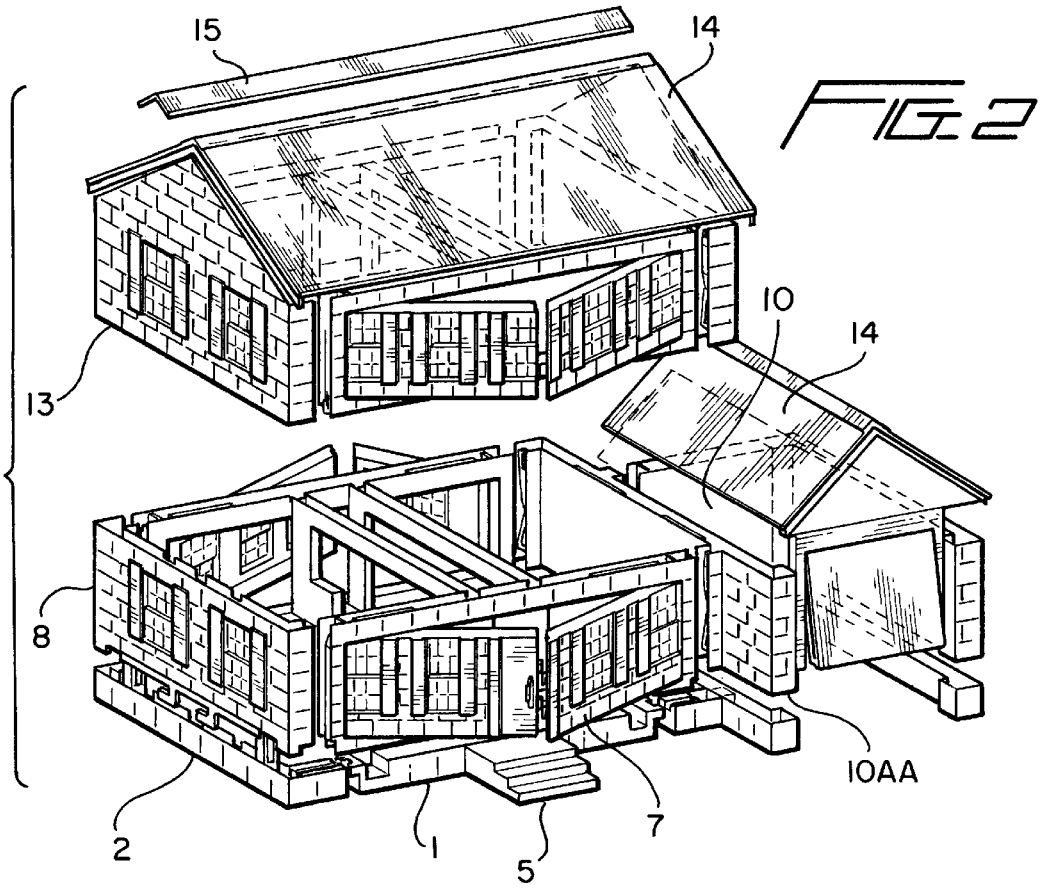
FIG. 2 is a perspective view of the house of FIG. 1.
Figure 1:
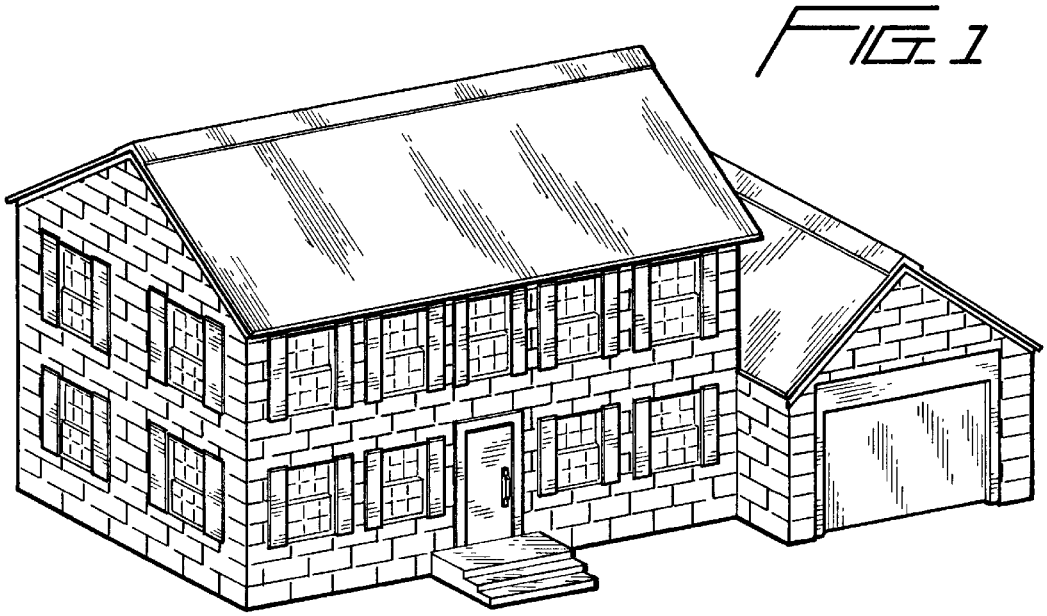
FIG. 1 is a perspective view of a model house in accordance with the invention.

FIG. 1 is a perspective view of the model building of this invention. FIG. 2 is an exploded view of FIG. 1 showing the pieces comprising the model building and their relationships. The pieces are preferably made of plastic frames covered with plastic panels. Preferably, boundary pieces have brick like plastic panels affixed on their exterior sides and specially designed wall panels affixed to interior sides. Plastic, vinyl, or cloth covered sheets make floors, ceilings, and roofs.

An advantage of the invention is that model buildings may be easily constructed in modular units. For example, a lower level module may be constructed including interior and exterior components. Subsequently an upper level module may be constructed and coupled to the lower level module. In this manner, a model building of any number of stories, designs and layouts may be readily fabricated. Due to the modular construction, such a model may also be easily modified without acquiring additional structural elements or complex adhering and re-adhering procedures.

In accordance with the invention, FIG. 3 shows a base frame unit 3AA that is a basic building block for the model of this invention. Preferably formed from two plastic strips, 3A, the base frame unit 3AA has notches 3B and 3C for positioning steps or porches, grooves 3D for floors and slots 3E that allow one base frame unit to be positioned perpendicular to another. The base frame unit 3AA may be equipped with posts 3G to facilitate interlocking of base pieces with lower level wall pieces, and arms 3H which will interlock with upper level wall pieces. The unit shown in FIG. 3 also supports most walls. Attachment 4A (FIG. 4-1) can be appended to each end of the base frame unit 3AA shown in FIG. 3 to form a structure similar to FIG. 4. As is apparent from FIG. 4, steps 5 may be coupled to plastic strip 3A. Upper edges of steps 5 extend and have slots that allow them to snap into place. Steps 5 also have an attachment bolt 4C used to tighten them to the base frame unit 3AA. Alternatively, steps 5 may be coupled to base frame unit 3AA by any commonly known coupling procedure. A porch or patio can be attached to the base frame unit 3AA in similar fashion.

FIG. 4 also shows part of two other base frame units 3X and 3Y attached perpendicularly to the base frame unit 3AA as support for interior walls. This can be done by slipping slot 3E at the end of the base frame unit 3AA through the space between the head of tab 3F and the wall of base frame unit 3AA. Also attached to each end of base frame unit 3AA is a base extension 4A. In addition, a corner block 5A, shown in detail in FIG. 5-1, can be attached to the end of the base frame unit 3AA to create base end and comer piece 2 shown in FIGS. 2 and 5.

FIGS. 6 and 7 detail frontrear side piece 7. FIG. 6 shows frontrear side piece 7 partially open. The piece includes an outer frame 7A shown in FIG. 7 and first and second pivoting frames 8AA shown in more detail in FIG. 8. Outer frame 7A preferably includes protrusions 7B that facilitate alignment with other pieces, and protrusions 7C and 7D used to help interlock piece 7 with other pieces. Frames 7A, 8AA may be covered with decorative facing 7R, preferably plastic panels resembling brick walls. In a preferred embodiment, the upper and bottom most vertical edges of the exterior plastic panels (not shown) may be notched and have strip 6B affixed on the back as shown in FIG. 6-1. This strip 6B may be used with complementing, upper and bottom-most vertical edges on frontrear side and end wall pieces as shown in FIG. 11-1 to help align and interconnect edges and obscure undesired seams that are created when frontrear side and end wall pieces are coupled. Shutters 7Q conceal the remaining portion of vertical seams, or abutting edges that lie between the interlocking portion of the edges.

FIGS. 9, 10, 11, and 12 illustrate other boundary wall pieces. All are similar except garage front and door piece 9AA as shown in FIG. 9. This piece includes an outer frame 9A, protrusions 9B and 9C for securing and alignment with base and wall pieces, and an inner frame 9D that is movable relative to the outer frame 9A. Also provided is a bolt 9E that tightens through the outer frame while moving the inner frame relative to the outer frame, a door 9F, a decorative facing, e.g., a brick like panel 9J, and strip 9I.

FIG. 10 illustrates the garage sidewall piece 10AA. This piece is similar to lower level end wall piece 8, except corners are-structured to engage garage front and door piece 9AA. It is typically used when the builder wants to construct a model having a garage.

Generally, end, side, and interior walls are made of frames such as frame 11 shown in FIGS. 11 and 12, respectively. Frame 11 may be covered with a decorative facing, e.g., plastic panels. Different panels may be pre-cut and then attached to identical frames to form garage side wall piece 10AA, lower level end wall piece 8, and upper level end wall piece 13. Interior walls are made the same way. The frames 11 generally include legs 11A that are detachable so that the placement of openings along walls can be varied. Frame has a securing mechanism 11B. for example, a turnbuckle, which facilitates coupling of a wall containing frame 11 to base frame unit 3AA. As depicted in FIG. 11, the securing mechanism 11B slides back and forth along a slot in the top of the frame 11 and hooks 11D engage posts 3G in base frame unit 3AA. Securing mechanism 11BB depicted in FIG. 12, is similar to securing mechanism 11B except it is stationary. Lower level end wall piece 8 is coupled to upper level end wall piece 13 by arms 3H in base frame unit 3AA. The turnbuckle may be turned clockwise thereby pulling hooks 11D up against the base pieces. Arms 3H extend upward through wall cavities and are positioned over the bottom most tips 12B of end wall piece 13.

FIG. 13 shows an end wall connector 13AA. The end wall connector is preferably disposed proximate to the edges of end walls 8 and 13. Preferably, exterior and interior decorative facing is adhered to end wall connector 13AA for aesthetic effect and to secure end wall connector 13AA to the edges of end walls 8 and 13 as depicted in FIG. 12.

Figure 14:
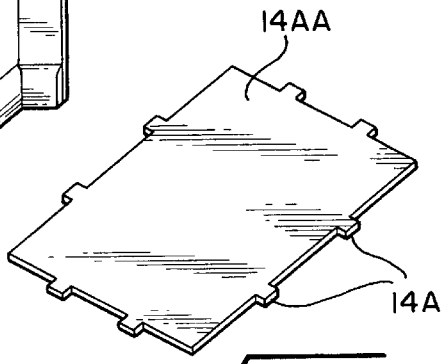
FIG. 14 shows a floor/ceiling panel.

FIG. 14 illustrates panel 14AA that is one of several pieces that may be used both as a ceiling and a floor. Panel 14AA is cut so that tabs 14A align with grooves 3D in the base frame unit 3AA to form lower level floors and so that tabs 14A align with grooves 15D at the top of end wall pieces 8 and 13 to form lower level ceiling sheets. A lower level ceiling sheet can be placed back-to-back with an upper level floor sheet and the space between them may be used to conceal material not intended to be viewed such as electrical wiring, if desired.

Figure 15:
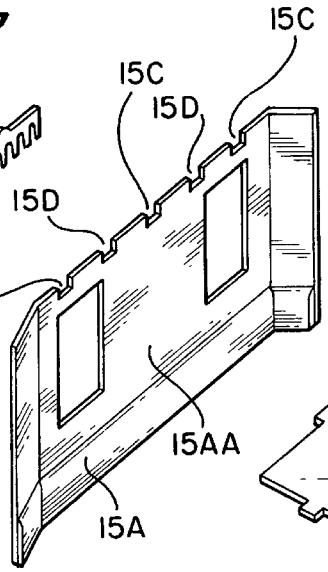
FIG. 15 shows an interior wall panel.

FIG. 15 illustrates an interior wall panel 15AA. The panel has a "U" shaped bottom edge 15A that resembles baseboard molding. The edge protrudes outward and slightly downward to conceal floor edges and apply pressure to floor pieces when the bolt 9E is tightened vertically. The cavity created by the "U" shaped bottom edge is used to hold items such as wallpaper sheets in place.

Figure 16:
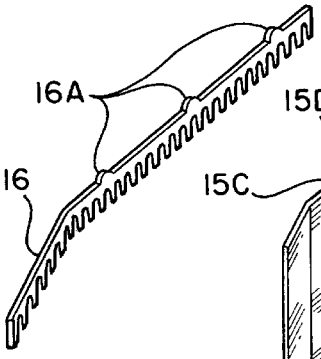
FIG. 16 illustrates a ceiling molding piece.

FIG. 16 depicts ceiling molding 16, which is sufficiently thick to accommodate lower level ceilings and upper level floors. Clips 16A engage grooves 15C at the top of interior wall piece 15AA to hold the ceiling molding 16 in place. The ceiling molding 16 is sufficiently deep to hold items such as wallpaper sheets in place.

Figure 17:
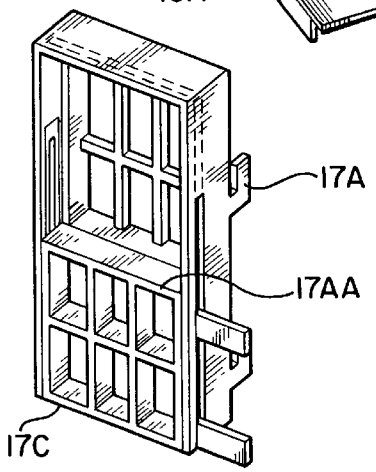
FIG. 17 shows a window structure.
Figure 18:
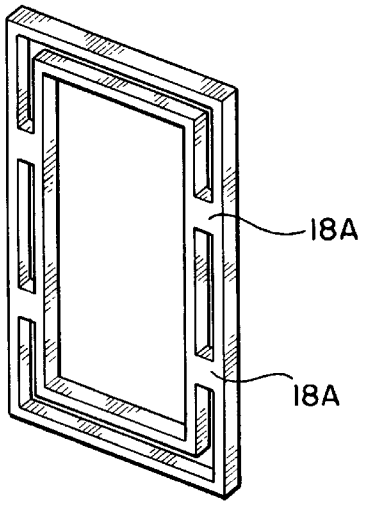
FIG. 18 shows an interior window molding.

FIG. 17 shows a center window structure 17AA. A lower section 17C moves up and down to operate latching devices that are released or engaged to open or lock front/rear side piece 7. The center window structure 17AA may be mounted to one pivoting frame (FIG. 8) and may be covered with panels resembling doors when a similarly functioning door handle, or knob, is required. Arms 17A on the backside of the window structure align with straps 18A in the window molding shown in FIG. 18. This molding is decorative and also helps secure wallpaper sheets to wall panels.

Figure 19:
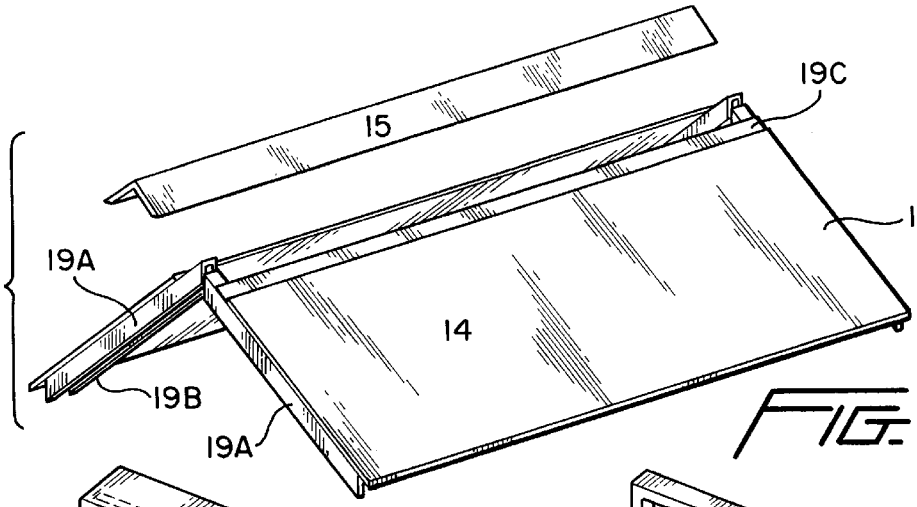
FIG. 19 depicts a roof piece.

A roof piece 19AA is shown in FIG. 19. Channel strips 19A are provided to serve as facial boards. The inside edge of the channel strips are bent at right angles and form a stop, 19B. The stop 19B engages slots 12A disposed in the top of upper level end wall 13, as shown in FIG. 12, to align the roof. A ridge board piece 15 is provided and secured by Velcro strip 19C at the top edge of the roof.

Model buildings of varying styles, layouts and interior designs may be constructed utilizing the elements described above and depicted in the drawings. By way of example, the illustrated embodiment (FIG. 1) is directed to a model house. Generally, in accordance with the invention, a preferred construction sequence begins with the base frame units, followed by lower level floors, sides, walls, interior walls, molding and ceiling pieces. Decorative features such as wallpaper and siding may be included in accordance with the builder's taste. Upper Level floors, sides, walls, and ceiling pieces are placed next. Similar to the lower level pieces decorative features such as wallpaper and siding may be included in accordance with the builder's taste. Placement of the roof and ridge board piece completes construction of the model.

Construction of the model depicted in FIG. 1 according to preferred aspects of the invention is described. Individual pieces and their relationships are shown in FIG. 2. Base pieces are shown in FIGS. 3 through 5. The preferred construction of the model is a modular construction. That is, discrete portions of the building are independently constructed and subsequently releasably attached to each other. In the illustrated embodiment, the model comprises a lower level module and an upper level module. However, the invention is not sol limited; it embraces structures comprised of multiple modules.

To initiate construction of the lower level module, base front/rear piece 1 is placed first. Shown in FIG. 4 without its exterior plastic panel, base front/rear piece 1 includes a base frame unit 3AA, a pair of extensions 4A shown in FIG. 4-1, and steps 5. Base front/rear piece 1 connects to base end and corner piece 2 shown in FIG. 5. Extension 4A includes thumb screws 4B for securing the base front and rear piece 1 to base end and corner piece 2. Base end and corner piece 2 includes base front/rear piece 1 and first and second corner attachments 5A, respectively disposed at each end of the base front/rear piece 1. The corner attachment 5A is depicted in FIG. 5-1. The corner attachment includes apertures 5B that receive thumb screw 4B thereby securing base front/rear piece 1 to base end and corner piece 2. This approach is repeated for other perimeter base pieces. Interior base pieces, base frame units 3X and 3Y, have the same construction as base frame unit 3AA. As depicted in FIG. 4, interior base frame units 3X and 3Y may be snap fit into place using slots 3E at the ends of the base frame unit 3AA and studs 3F on the backside of base front/rear piece 1.

Steps 5 may be coupled to base front and rear piece 1. Steps 5 include extended top edges having notches (not shown) that interlock with slots 3B in the base front/rear piece 1. Attachment bolt 4C is provided to lock the steps 5 in place.

Next, panels 14AA, shown in FIG. 14, are lowered into place on the base pieces. Tabs 14A on panels 14AA rest in notches 3D in the base pieces. When used as a floor, panel 14AA may be decoratively adorned with wood flooring material, carpet, tile or the like. A panel 14AA may function as a lower level ceiling piece and a second panel 14AA may function as an upper level floor and ceiling piece. The lower level ceiling piece and the upper level floor piece may be placed back-to-back so that electrical wiring can be run and hidden between them. If desired, apertures may be formed in the floor and ceiling pieces to position electrical fixtures therein.

The next step is to position lower level walls. According to a preferred embodiment, two front/rear side pieces 7, shown in FIG. 6, are coupled to base front/rear piece 1. Front/rear side piece 7 includes an outer frame 7A, shown in dA FIG. 7 and a pair of pivoting frames 8AA illustrated in FIG. 8. Posts 7B engage openings 4E in the base front/rear piece 1. The front/rear side piece 7 opens and closes thereby allowing access to compartments on both the front and rear sides of the model. Placement of the front/rear side piece 7 is followed by that of lower level end wall piece 8 (FIG. 11). If additional detail is desired, garage side wall piece 10AA (FIG. 10), and garage end wall piece 10 (which is shown only in FIG. 1) may be added.

In furtherance of the invention, end walls may be connected and aligned as follows. Turning to lower level end wall piece 8, it includes posts 11E andy hooks 11D. To facilitate positioning of lower level end wall piece 8, posts 11E are placed into openings 5C in the base end and comer piece 2 depicted in FIG. 5. To promote alignment and securing between front/rear side piece 7 and lower level end wall piece 8, a wall connector 13AA, depicted in FIG. 13, is coupled to the front/rear side piece 7. Wall connector 13AA includes arms 13A extending from a base 13F. A clip assembly is disposed between and pivotally coupled to adjacent arms 13A. The clip assembly includes a connector clip 13B attached to a structural member 13C. A securing hook 13D is connected to structural element 13C. The hook 13*d* is preferably pivotable with respect to structural element 13C. To accomplish alignment and securing, arms 13A may be aligned with vertical edges of the front/rear side piece 7. The wall connector clip 13B engages hook 7C causing structural member 13C to be pulled forward and, thus, hook 13D to engage with notch 7D in locking fashion. Consequently, the edges of front/rear side pieces 7 and lower level wall pieces 8 are positioned snugly against each other.

Ordinarily, one would expect that the attachment of front/rear side piece 7 to lower level end wall piece 8 would generate unsightly seams along the decorative facing. However, in accordance with a preferred aspect of the invention, such seams are made to blend with the decorative facing. The upper and bottom most abutting edges are detailed in breakout FIGS. 6-1 and 11-1; they interlock to hide the seams. In the exemplary embodiment shown and described herein, the edge of the brick-like plastic panel seen in FIG. 6-1 is notched and has an attached plastic strip 6B. The strip slides into the groove 11F shown in FIG. 11, the notched edge in FIG. 6-1 complements the abutting edge of the wall shown in FIG. 11-1. Groove 11F is formed by attaching an "L" shaped plastic strip to the inside edge of the exterior wall. Shutters 7Q hide the remaining portion of the vertical seams that are not concealed via interlocking edges.

After placement of the walls (pieces 8, 9, and 10) the garage front and door piece 9AA, FIG. 9, is placed. It consists of outer frame 9A, inner frame 9D, bolt 9E, door 9F and an affixed upper exterior sheet. The inner frame 9D moves up and down when bolt 9E is tightened. The inner frame movement creates an opposing movement on the outer frame. Studs 9B engage posts in garage base piece 3. Clips 9c engage openings 10B and 10C of garage end wall piece 10 and garage side wall piece 9. As bolt 9E is operated it tightens and pushes the inner frame 9D downward and secures garage front and door piece 9AA against the garage base and wall pieces. The garage door 9F swings on tabs, not shown. Slot 9H allows the garage door 9F to be opened and slid back to rest along the top side of the garage ceiling when access to the garage is desired. Notches 9G allow the door to rest in a closed position.

Next, interior wall pieces (shown only in FIG. 2) are placed. They rest on base frame units 3 and lower level floors and have posts that extend into interior base pieces for positioning. The frame and parts are similar to those shown in FIGS. 11 and 12 and can be varied, if desired. Walls are preferably plastic sheets as shown in FIG. 15, but without corner flaps. For positioning purposes, the top of the interior wall piece panels extends so as to fit into openings 6A in the frontrear pieces 7. Interior wall pieces are tightened vertically to the base. Securing mechanism 11BB has a bolt 11B that slides along the top of frame 11 moving bar 11C in the process. This engages hooks 11D with posts 3G in all base pieces. After hooks 11D and posts 3G engage, the bolt is operated thereby tightening wall pieces against base and floor pieces. Bar 11C balances and distributes pressure as the bolt is tightened.

Wall paper and decorative molding is placed next. The paper is cut to the desired wall size and is attached by slipping it into the cavity created by lip 15A at the bottom of all interior walls. Window molding in FIG. 18 has bands 18A designed to slip over arms 17A on door and window frames to further hold wall paper in place. Ceiling molding 16 holds the top of wall paper in place. Clips 16A affixed to the back of ceiling molding 16 fit notches 15C atop inside walls shown in FIG. 15 and hold ceiling molding 16 in place. Ceiling molding 16 also provides support for lower level ceilings and upper level floors. Floors and ceiling are similarly made from plastic sheets, e.g., panels 14AA shown in FIG. 14.

The construction of the upper level module is similar to that of the lower level module in many ways. Namely, the sequence and placement of upper level floors, walls, wall paper, and ceiling pieces is similar to that of the lower level. One of the differences occurs in how walls are vertically tightened. With the upper level wall, the securing mechanism 11B does not slide, and tips 12B in the lower bar (FIG. 12) engage arms 3H in the base unit shown in FIG. 3. Arms 3H are pivotally attached to base frame unit 3AA and can be manipulated from the bottom of the model. The bolt in the upper level end wall piece 13 is tightened as with the lower level pieces thereby tightening all upper level wall pieces against upper level floor, lower level wall and base pieces. More particularly, as the bolt 11B is tightened, securing mechanism 11BB moves upwards. This movement raises bar 11C thus causing tips 12B to engage arms 3H of base frame unit 3AA.

Placement of roof pieces completes construction. Roof piece 19AA of FIG. 19 has a channel strip 19A to facilitate placement. The channel strip 19A may be designed to resemble facial boards. A groove is provided in the channel strip 19A. The groove is of sufficient thickness to receive exterior wall sheets. One side of the channel strip 19A forms a box 19B. The box works in connection with Slot 12A in FIG. 12 and stops or positions the roof piece 19AA. A Velcro-type strip 19C may be provided to hold the roof ridge board piece 15 in place.

The connecting, latching, and seam concealment approaches described in this invention can be accomplished differently. Connecting devices contained within wall panels can also consist of tension bands similar to rubber bands. Devices consisting of clamps, springs, or other tension creating devices can also be used.

Other latching approaches can also be used within the context of the invention. Instead of latching front/rear side pieces via movement of front and rear center windows for the upper level, or vertical moving door handles or knobs for the lower level, different methods may be used. One such method would be the placement of raised dots on the top of pivoting frames 7F shown FIG. 7-1 used in conjunction with indentations made inside of front/rear frame 7A. Additionally, snaps, clasps, or Velcro may be attached to edges of the plastic panels and arranged so as to secure models shut.

A seam concealment approach using affixed strips, associated and corresponding notches has been described with this invention. Other methods will work. Sponge and rubber like linings can be affixed to abutting edges so as to resemble mortar and hide seams when the edges are pulled tightly together.

Moreover, while the various parts of the model have been described as made of plastic, some or all of the parts may be constructed of any material suitable for models; i.e., natural wood, cardboard, artificial wood or any other suitable synthetic material.

What is claimed is:

1. In combination:

at least one lower level module, said at least one lower level module including: 1) a base having a plurality of frame units, at least one of the frame units having a module attachment member, the module attachment member includes an arm pivotably coupled to the at least one frame unit, 2) a first wall element, the first wall element including a wall frame having a first securing mechanism for releasably securing the first wall element to the base, 3) a second wall element having a second securing mechanism for releasably securing the second wall element to the base; and 4) a wall connector for interconnecting the first and second wall elements; and an upper level module including: 1) a first wall element, the first wall element including a wall frame having a first securing mechanism for releasably securing the first wall element to a structure, 2) a second wall element having a second securing mechanism for releasably securing the second wall element to the structure; and 3) a wall connector for interconnecting the first and second wall elements.

2. The combination of claim 1, wherein the wall frame of the first wall element of the upper level module includes a coupling member.

3. A module for a modular building structure comprising:

a base including a plurality of frame units, at least one of the frame units having a module attachment member;

a first wall element including a wall frame having a first securing mechanism for releasably securing said first wall element to said base;

a second wall element having a second securing mechanism for releasably securing said second wall element to said base and including a frame having first and second pivotable frame unit members; and a wall connector for interconnecting said first and second wall elements.

4. A module for a modular building structure as claimed in claim 3 wherein said first and second wall elements include a plurality of windows.

5. A module for a modular building structure as claimed in claim 3 wherein said first and second wall elements include a decorative facing.

6. A module for a modular building structure as claimed in claim 5 wherein the decorative facing of said second wall element includes a notch disposed proximate to an edge of said second wall element.

7. A module for a modular building structure as claimed in claim 6 wherein said wall connector includes a decorative facing and the decorative facing includes a groove that mates with the notch in the decorative facing of the second wall element.

8. A module for a modular building structure as claimed in 3 wherein the module attachment member includes an arm pivotably coupled to the at least one frame unit.

9. A module for a modular building structure as claimed in claim 3 wherein the first securing mechanism includes a tumbuckle coupled to the wall frame.

10. A module for a modular building structure as claimed in claim 9 wherein the wall frame includes a movable member and the turnbuckle is operatively associated with the movable member to secure said first wall element to said base.

11. A module for a modular building structure as claimed in claim 9 wherein the wall frame of said first wall element includes a coupling member.

* * * * *